US009421682B2

(12) United States Patent
McClaskey et al.

(10) Patent No.: US 9,421,682 B2
(45) Date of Patent: Aug. 23, 2016

(54) MULTI-HEAD POWER TOOL WITH REVERSE LOCK-OUT CAPABILITY

(75) Inventors: Steven McClaskey, North Las Vegas, NV (US); John S. Vantran, Parkton, MD (US)

(73) Assignee: BLACK & DECKER INC., New Britain, CT (US)

( * ) Notice: Subject to any disclaimer, the term of this patent is extended or adjusted under 35 U.S.C. 154(b) by 922 days.

(21) Appl. No.: 13/541,404

(22) Filed: Jul. 3, 2012

(65) Prior Publication Data

US 2013/0020103 A1 Jan. 24, 2013

Related U.S. Application Data

(60) Provisional application No. 61/508,962, filed on Jul. 18, 2011.

(51) Int. Cl.
*B25F 3/00* (2006.01)

(52) U.S. Cl.
CPC ..... *B25F 3/00* (2013.01); *Y10T 74/20636* (2015.01)

(58) Field of Classification Search
CPC ..... B25F 3/00; B25F 5/02; B25F 5/024; B25F 5/028; B25F 5/021; B25D 17/005; B25D 2250/121
USPC ..... 173/29, 170, 217, 46, 132, 213; 74/527
See application file for complete search history.

(56) References Cited

U.S. PATENT DOCUMENTS

| | | | |
|---|---|---|---|
| 1,965,669 | A | 7/1934 | Robb |
| 2,713,271 | A | 7/1955 | Dodegge |
| 2,893,175 | A | 7/1959 | Bruck |
| 2,898,616 | A | 8/1959 | Coover |
| 3,097,571 | A | 7/1963 | Kaman |
| 3,390,412 | A | 7/1968 | Wolter et al. |
| 3,525,912 | A | 8/1970 | Wallin |
| 3,533,193 | A | 10/1970 | Dudek et al. |
| 3,566,895 | A | 3/1971 | Goto |
| 3,638,362 | A | 2/1972 | Stoll |

(Continued)

FOREIGN PATENT DOCUMENTS

| | | |
|---|---|---|
| CN | 2074697 U | 4/1991 |
| DE | 2748502 A1 | 5/1979 |

(Continued)

OTHER PUBLICATIONS

Non-Final Office Action dated Jul. 15, 2013 in U.S. Appl. No. 13/863,018, 18 pages.

(Continued)

*Primary Examiner* — Gloria R Weeks
*Assistant Examiner* — Chinyere Rushing-Tucker
(74) *Attorney, Agent, or Firm* — Stephen R. Valanclus

(57) ABSTRACT

A handheld power tool having a detachable tool head is disclosed in which, depending on the type of tool head used, selection of reverse movement of the rotary assembly of the power tool can be prevented. Where reverse movement of the tool head is undesirable, such as for a saw blade, the tool head contains a contact plate that slides a plate member to a position to prevent selection of the reverse direction by the user. However, where reverse movement of a tool head is desired, such as for a drill head, the plate member remains in its original position such that forward and reverse directions can be selected by a user.

20 Claims, 9 Drawing Sheets

(56) References Cited

U.S. PATENT DOCUMENTS 3,724,237 A 4/1973 Wood
3,747,594 A 7/1973 Bishop
3,759,336 A 9/1973 Marcovitz et al.
3,761,663 A 9/1973 Brown
3,793,776 A 2/1974 Sadow, Jr. et al.
3,841,416 A 10/1974 Pfister
3,874,125 A 4/1975 Stroezel
3,899,852 A 8/1975 Batson et al.
3,908,139 A 9/1975 Duncan, Jr.
3,952,239 A 4/1976 Owings et al.
3,973,179 A 8/1976 Weber et al.
4,050,528 A 9/1977 Foltz et al.
4,052,824 A 10/1977 Hutchins
4,091,880 A 5/1978 Troutner et al.
4,125,339 A 11/1978 Pittinger
4,251,120 A 2/1981 Wolff
RE30,680 E 7/1981 Kress et al.
4,304,071 A 12/1981 Obrecht
4,307,325 A 12/1981 Saar
4,355,251 A 10/1982 Alessio et al.
4,410,846 A 10/1983 Gerber et al.
4,504,769 A 3/1985 Fushiya et al.
4,513,381 A 4/1985 Houser, Jr. et al.
4,625,462 A 12/1986 Fushiya et al.
4,628,459 A 12/1986 Shinohara et al.
4,728,942 A 3/1988 England
4,754,575 A 7/1988 Schneider
4,779,687 A 10/1988 Schreiber et al.
4,827,552 A 5/1989 Bojar et al.
4,834,596 A 5/1989 Hollifield et al.
4,835,409 A 5/1989 Bhagwat et al.
4,835,410 A 5/1989 Bhagwat et al.
4,844,177 A 7/1989 Robinson et al.
4,871,629 A 10/1989 Bunyea
4,962,681 A 10/1990 Yang
4,995,148 A 2/1991 Bonomi et al.
5,018,314 A 5/1991 Fushiya et al.
5,018,411 A 5/1991 LaPadura
5,033,552 A 7/1991 Hu
5,128,783 A 7/1992 Abileah et al.
5,149,230 A 9/1992 Nett
5,157,873 A 10/1992 Rudolf et al.
5,170,579 A 12/1992 Hollinger
5,241,053 A 8/1993 Fujisawa et al.
5,296,768 A 3/1994 Burger
5,374,088 A 12/1994 Moretti et al.
5,386,667 A 2/1995 Hausslein et al.
5,392,568 A 2/1995 Howard et al.
5,398,454 A 3/1995 Berner
5,398,457 A 3/1995 Updegrave et al.
5,421,053 A 6/1995 Chodak et al.
5,441,450 A 8/1995 Fein et al.
5,490,683 A 2/1996 Mickel et al.
5,563,482 A 10/1996 Shaw et al.
5,580,302 A 12/1996 Howard et al.
5,653,296 A * 8/1997 Fujiyama ..... H01H 13/08 173/170
5,679,066 A 10/1997 Butz et al.
5,709,595 A 1/1998 Bergner et al.
5,715,156 A 2/1998 Yilmaz et al.
5,771,516 A 6/1998 Huang
5,839,949 A 11/1998 Martin et al.
5,885,146 A 3/1999 Cockburn
5,941,891 A 8/1999 Walen et al.
5,988,025 A 11/1999 Sasaki et al.
6,004,194 A 12/1999 Hild et al.
6,039,126 A 3/2000 Hsieh
6,062,575 A 5/2000 Mickel et al.
6,062,960 A 5/2000 Kai et al.
6,104,162 A 8/2000 Sainsbury et al.
6,126,370 A 10/2000 Wheeler et al.
6,132,300 A 10/2000 Martin et al.
6,139,359 A 10/2000 Fuhreck et al.
6,153,838 A 11/2000 Wadge
6,159,084 A 12/2000 Tiede
6,170,579 B1 1/2001 Wadge
6,176,322 B1 1/2001 Wadge
6,179,696 B1 1/2001 Duffy
6,206,107 B1 3/2001 Wadge
6,224,303 B1 5/2001 Wheeler et al.
6,237,698 B1 5/2001 Carrier et al.
6,243,276 B1 6/2001 Neumann
6,244,933 B1 6/2001 Morkvenas
6,263,980 B1 7/2001 Wadge
6,270,087 B1 8/2001 Mickel et al.
6,286,609 B1 9/2001 Carrier et al.
6,286,611 B1 * 9/2001 Bone ..... 173/216
6,296,065 B1 10/2001 Carrier
6,306,024 B1 10/2001 Kai et al.
6,343,901 B2 2/2002 Wheeler et al.
6,446,734 B1 9/2002 Williams et al.
6,460,626 B2 10/2002 Carrier
6,488,710 B2 12/2002 Besselink
6,502,949 B1 1/2003 Horiyama et al.
6,553,642 B2 4/2003 Driessen
6,573,621 B2 6/2003 Neumann
6,601,621 B2 8/2003 Wixey et al.
6,613,089 B1 9/2003 Estes et al.
6,634,439 B2 10/2003 Driessen
6,641,467 B1 * 11/2003 Robson et al. ..... 451/334
6,675,911 B2 1/2004 Driessen
6,675,912 B2 1/2004 Carrier
6,708,744 B2 3/2004 Wixey et al.
6,780,094 B2 8/2004 Walker
6,805,207 B2 10/2004 Hagan et al.
6,860,342 B1 3/2005 Wu et al.
6,875,095 B2 4/2005 Walker
6,886,615 B2 5/2005 Wixey et al.
6,910,694 B2 6/2005 Hartmann et al.
6,918,419 B2 7/2005 Wixey et al.
7,021,399 B2 4/2006 Driessen
7,048,617 B1 5/2006 Spiva
7,096,974 B2 8/2006 Obermeier et al.
7,114,824 B2 10/2006 Picone
7,198,559 B2 4/2007 Walstrum et al.
7,220,174 B2 5/2007 Phillips et al.
7,235,005 B2 6/2007 Schnell et al.
7,270,591 B2 9/2007 Deshpande et al.
7,270,910 B2 9/2007 Yahnker et al.
7,371,150 B2 5/2008 Deshpande et al.
7,428,917 B2 9/2008 Wixey et al.
7,504,791 B2 3/2009 Sieber et al.
7,526,833 B2 5/2009 Cochran et al.
7,568,867 B2 8/2009 Bryan
7,609,025 B2 10/2009 Griffin
7,649,337 B2 1/2010 Uehlein-Proctor et al.
7,653,963 B2 2/2010 Cochran et al.
7,713,110 B2 5/2010 Lampka et al.
7,719,230 B2 5/2010 Griffin
7,722,435 B2 5/2010 King
7,736,216 B2 6/2010 King et al.
7,743,683 B2 6/2010 Dayton et al.
7,770,660 B2 8/2010 Schroeder et al.
7,815,356 B2 10/2010 Lutz et al.
7,825,615 B2 11/2010 Chen et al.
7,828,630 B2 11/2010 Robson et al.
7,913,345 B2 3/2011 Dayton et al.
7,926,141 B2 4/2011 Dayton et al.
8,172,642 B2 5/2012 King et al.
8,251,157 B2 8/2012 Gray et al.
8,267,192 B2 9/2012 Lopano et al.
8,381,830 B2 2/2013 Puzio et al.
8,398,457 B2 3/2013 King et al.
8,613,644 B2 12/2013 King et al.
8,839,879 B2 9/2014 Elger et al.
2001/0023525 A1 * 9/2001 Driessen ..... 29/453
2002/0020539 A1 * 2/2002 Driessen ..... 173/216
2002/0050366 A1 * 5/2002 Driessen ..... 173/216
2002/0050368 A1 * 5/2002 Driessen ..... 173/217
2002/0148623 A1 10/2002 Pan
2003/0097178 A1 5/2003 Roberson et al.
2003/0109207 A1 6/2003 Wuensch
2003/0130742 A1 7/2003 Connelly et al.
2004/0220672 A1 11/2004 Shadduck

(56) References Cited

U.S. PATENT DOCUMENTS

| | | | | |
|---|---|---|---|---|
| 2005/0076972 | A1 | 4/2005 | Wixey et al. | |
| 2006/0019585 | A1 | 1/2006 | Zayat et al. | |
| 2006/0146571 | A1 | 7/2006 | Whitney | |
| 2007/0095149 | A1 | 5/2007 | Sieber et al. | |
| 2008/0311832 | A1 | 12/2008 | King | |
| 2009/0010725 | A1 | 1/2009 | Egelund | |
| 2009/0126964 | A1 | 5/2009 | Schroeder et al. | |
| 2009/0239451 | A1 | 9/2009 | Geiser et al. | |
| 2010/0048101 | A1 | 2/2010 | King et al. | |
| 2010/0146797 | A1 | 6/2010 | Dreher | |
| 2010/0282485 | A1* | 11/2010 | Puzio et al. | 173/217 |
| 2010/0288520 | A1 | 11/2010 | Dayton et al. | |
| 2010/0328929 | A1 | 12/2010 | Lutz et al. | |
| 2011/0011610 | A1* | 1/2011 | Welke et al. | 173/217 |
| 2011/0036604 | A1 | 2/2011 | Worsnop et al. | |
| 2011/0094763 | A1 | 4/2011 | Wei | |
| 2011/0100661 | A1 | 5/2011 | Wei | |
| 2011/0100662 | A1 | 5/2011 | Wei | |
| 2011/0100663 | A1 | 5/2011 | Wu | |
| 2011/0108298 | A1 | 5/2011 | Zhou | |
| 2011/0108299 | A1 | 5/2011 | Wei | |
| 2011/0121782 | A1 | 5/2011 | Marsh et al. | |
| 2011/0272172 | A1 | 11/2011 | Lau et al. | |
| 2012/0111915 | A1* | 5/2012 | Miyashita | 227/8 |
| 2013/0020103 | A1 | 1/2013 | McClaskey et al. | |
| 2013/0105187 | A1* | 5/2013 | Agehara et al. | 173/20 |
| 2014/0024301 | A1 | 1/2014 | King et al. | |
| 2014/0338947 | A1 | 11/2014 | Boeck et al. | |

FOREIGN PATENT DOCUMENTS

| | | | |
|---|---|---|---|
| DE | 2933355 | A1 | 3/1981 |
| DE | 3142749 | A1 | 5/1982 |
| DE | 3538225 | A1 | 4/1987 |
| DE | 19617572 | A1 | 11/1997 |
| EP | 0022222 | A1 | 1/1981 |
| EP | 0033161 | A1 | 8/1981 |
| EP | 0086114 | A1 | 8/1983 |
| EP | 0542667 | A2 | 5/1993 |
| EP | 0610801 | A1 | 8/1994 |
| EP | 0906812 | A2 | 4/1999 |
| EP | 1584412 | A2 | 10/2005 |
| EP | 2338644 | | 6/2011 |
| EP | 2338644 | A2 | 6/2011 |
| FR | 2568377 | A1 | 1/1986 |
| GB | 2073062 | A | 10/1981 |
| JP | 10286772 | A | 10/1998 |
| WO | 2001096067 | A1 | 12/2001 |

OTHER PUBLICATIONS

Final Office Action dated Nov. 7, 2013 in U.S. Appl. No. 13/863,018, 24 pages.

Non-Final Office Action dated Feb. 11, 2014 in U.S. Appl. No. 13/863,018, 30 pages.

Final Office Action dated Jul. 8, 2014 in U.S. Appl. No. 13/863,018, 16 pages.

Non-Final Office Action dated Nov. 13, 2014 in U.S. Appl. No. 13/863,018, 23 pages.

Final Office Action dated Mar. 20, 2015 in U.S. Appl. No. 13/863,018, 23 pages.

Non-Final Office Action dated Feb. 12, 2015 in U.S. Appl. No. 13/530,629, 11 pages.

Final Office Action dated Aug. 7, 2015 in U.S. Appl. No. 13/530,629, 9 pages.

* cited by examiner

MULTI-HEAD POWER TOOL WITH REVERSE LOCK-OUT CAPABILITY

CROSS-REFERENCE TO RELATED APPLICATIONS

This application, claims the benefit of and priority to commonly owned U.S. Provisional Application Ser. No. 61/508,962, filed Jul. 18, 2011, which is hereby incorporated by reference in its entirety.

STATEMENT REGARDING FEDERALLY SPONSORED RESEARCH OR DEVELOPMENT

Not applicable.

TECHNICAL FIELD

The present invention relates generally to a handheld power tool having interchangeable tool heads where the direction of rotary movement of the tool head is controllable.

BACKGROUND

Since their inception, power tools have provided craftsman with improved performance and ease of use. In more recent years, advancements in portable power technology have lead to incorporating the improved performance provided by a power tool into a handheld and often times, cordless configuration. These handheld power tools have provided increased flexibility and freedom of use by operators as well as increased efficiency by craftsman. A handheld power tool generally includes a handle mechanism, a trigger switch, a tool head, and a motor capable of moving the tool head in a desired direction.

To further increase ease of use and flexibility, some handheld power tools have advanced so as to permit interchangeability of the tool head. By permitting interchangeability, the same handle mechanism and motor can be used to operate different types of tool heads, such as a drill or driver, a circular saw, a sander, or a jigsaw. While this interchangeability provides convenience to the user, it also introduces the risk of permitting undesirable movement of the tool head, which can lead to serious injury of the tool operator, damage to the power tool, or damage to the surface on which the tool is operating. That is, certain tools heads such as a sander, jigsaw or circular saw are preferably not operated in a reverse direction.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention are directed to a handheld power tool and a component thereof which restricts selection of reverse movement of the rotary assembly depending on the type of detachable tool head fixed to the power tool. In one aspect, an embodiment of the present invention is directed to a handheld power tool comprising a handle, a tool housing, a rotary assembly having a shaft, a plate member with an opening for regulating movement of the shaft, a detachable tool head capable of contacting the plate member, and a retainer pin positioned within the opening and coupled to a direction-selection switch. Depending on the type of tool head installed on the tool housing and rotary assembly, the plate member may slide axially so as to limit movement of the retainer pin, thereby preventing movement of the direction-selection switch to a position where the shaft of the rotary assembly moves in a reverse direction.

In another aspect of the present invention, a plate member for controlling a rotating member of a handheld power tool is disclosed, where the plate member is formed from sheet metal and has an opening located therein, with the opening having a series of edges, where at one end of the opening a retainer pin can move between two positions (forward and neutral) and at an opposing end of the opening, the retainer pin can move between three positions (forward, neutral, and reverse).

In yet another aspect, an embodiment of the present invention is directed to a direction-controlling assembly of a handheld power tool comprising a plate member with an opening having a series of edges to define a region in which a retainer pin is permitted to move, where the retainer pin is coupled to a direction-selection switch. The position of the plate member relative to the retainer pin depends on the type of tool head attached to the handheld power tool. Therefore, depending on the type of tool head attached to the power tool, the plate member can slide and restrict movement of the retainer pin and, in turn, the direction-selection switch.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION

Figure 1:
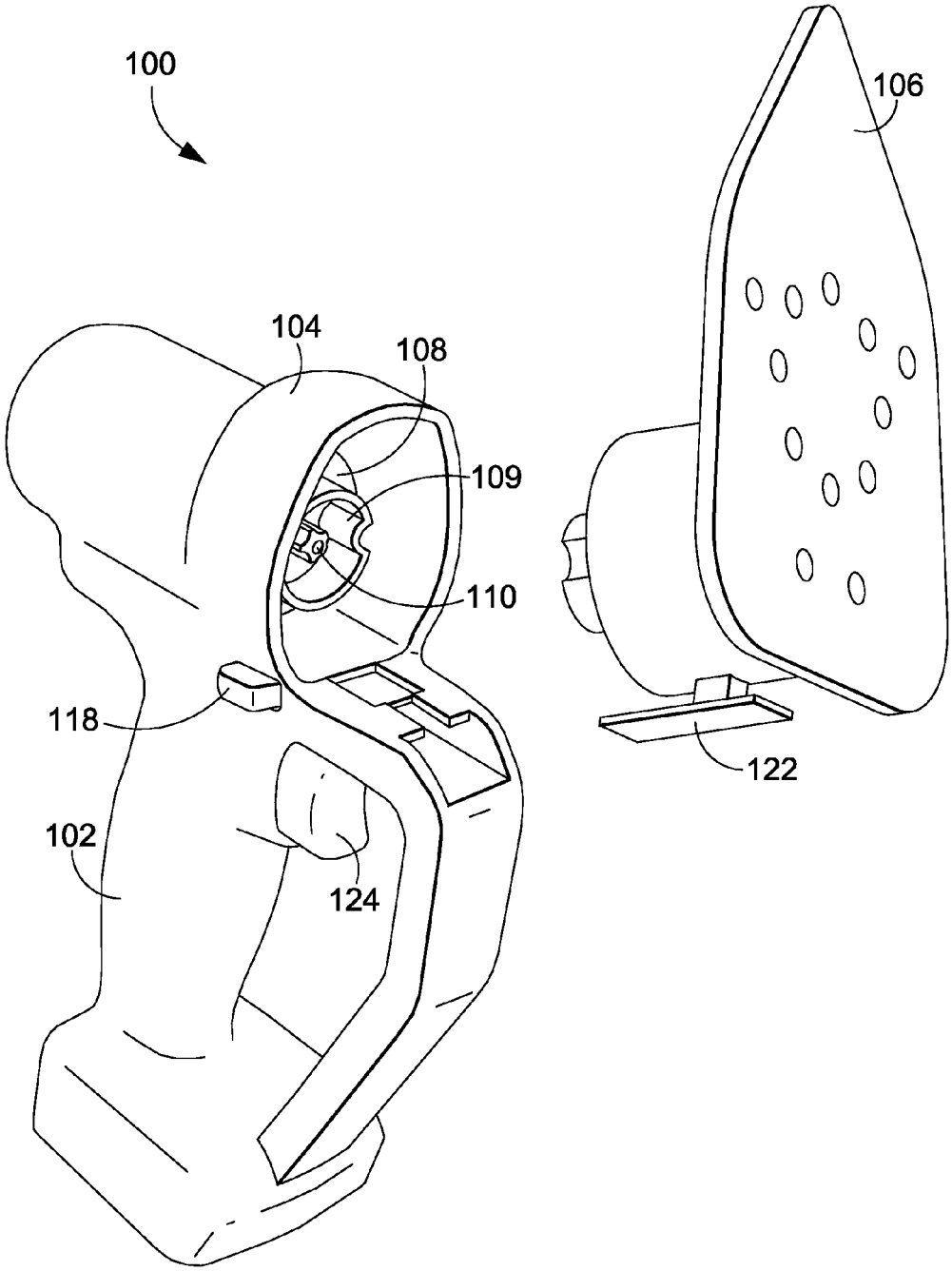
FIG. 1 is a perspective view of handheld power tool assembly and tool head in accordance with an embodiment of the present invention.

With reference to the drawings, wherein like reference characters designate like parts throughout the different views, a handheld power tool 100 is depicted in FIGS. 1-5. Specifically, the handheld power tool 100 comprises a handle 102, coupled to a tool housing 104, where the tool housing 104 is sized to receive a detachable tool head 106 and encloses a rotary assembly 108. The rotary assembly 108 includes a motor (not shown) which drives a rotatable shaft 110 in both a forward and reverse direction. The rotary assembly also includes an alignment flange 109 which cooperates with the tool head to assure proper orientation of the tool head 106 when coupled with the tool housing 104. The handle 102 and tool housing 104 may be constructed as one integral part through a casted metal casing or plastic molded construction or alternatively through a mechanical coupling of individual components.

Figure 2:
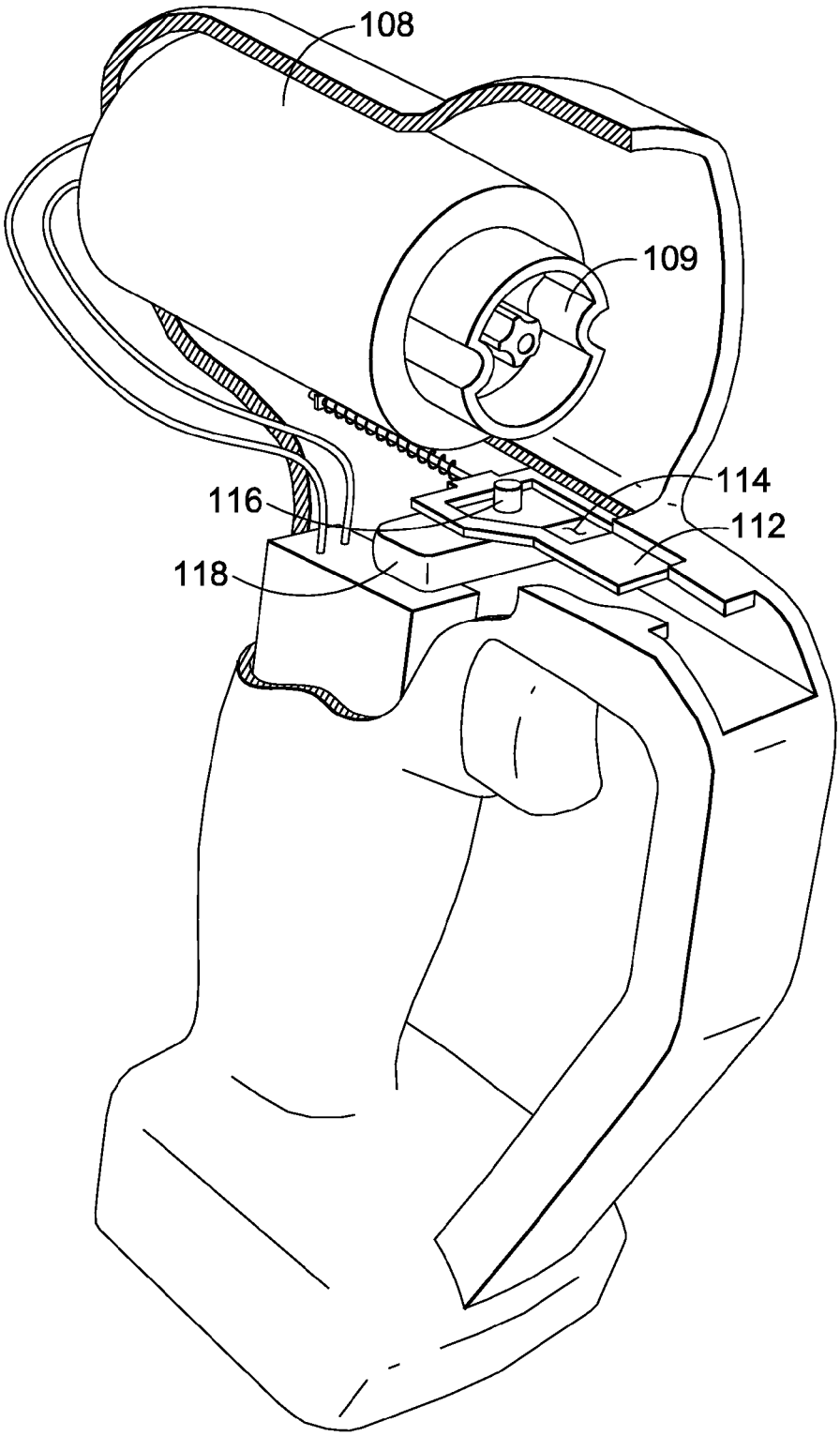
FIG. 2 is a partial cross section view of a portion of the handheld power tool assembly of FIG. 1 in accordance with an embodiment of the present invention.
Figure 3:
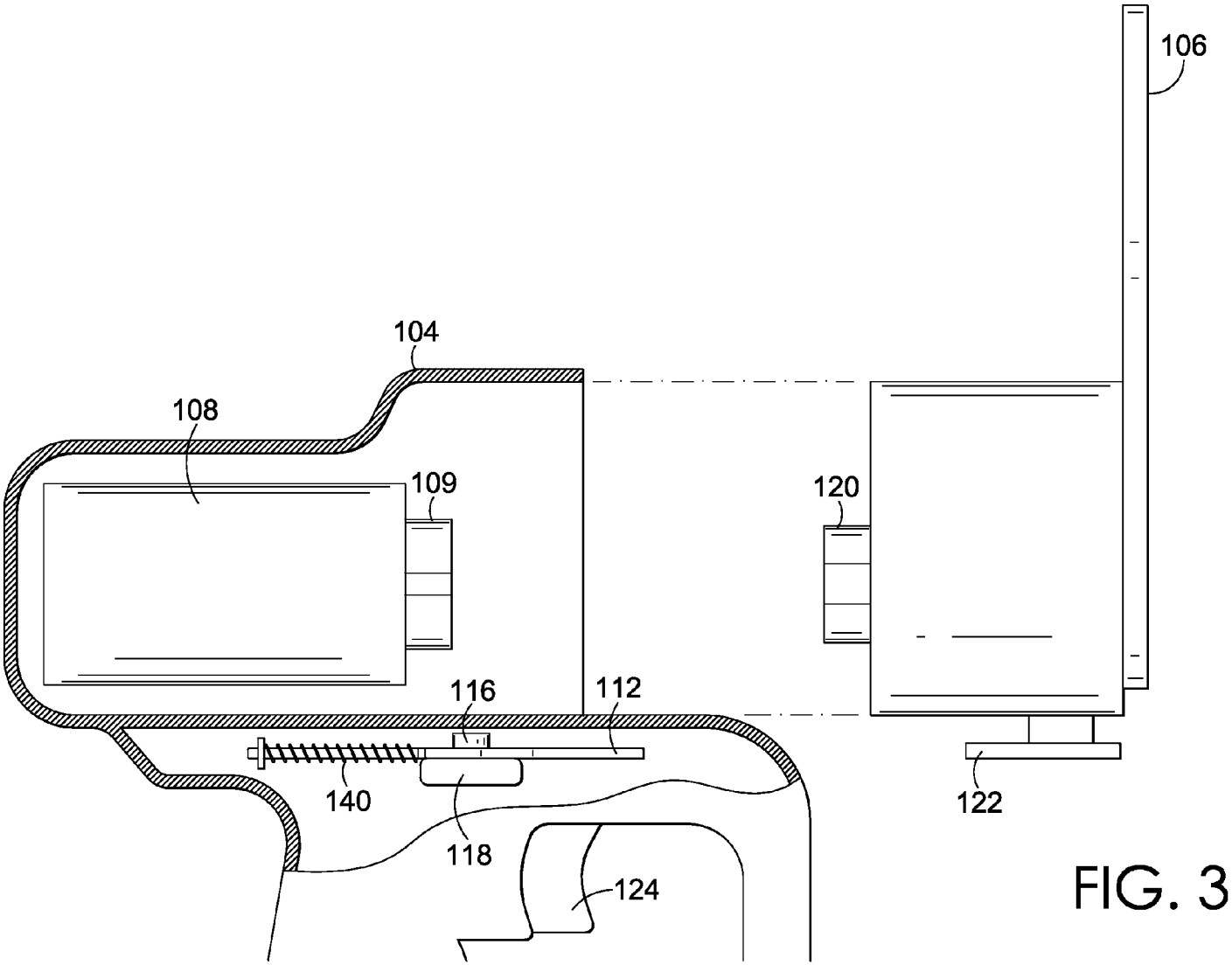
FIG. 3 is a fragmentary, cross section view of a portion of the handheld power tool assembly and tool head of FIG. 1 in which the tool head is shown in a detached position in accordance with an embodiment of the present invention.
Figure 4:
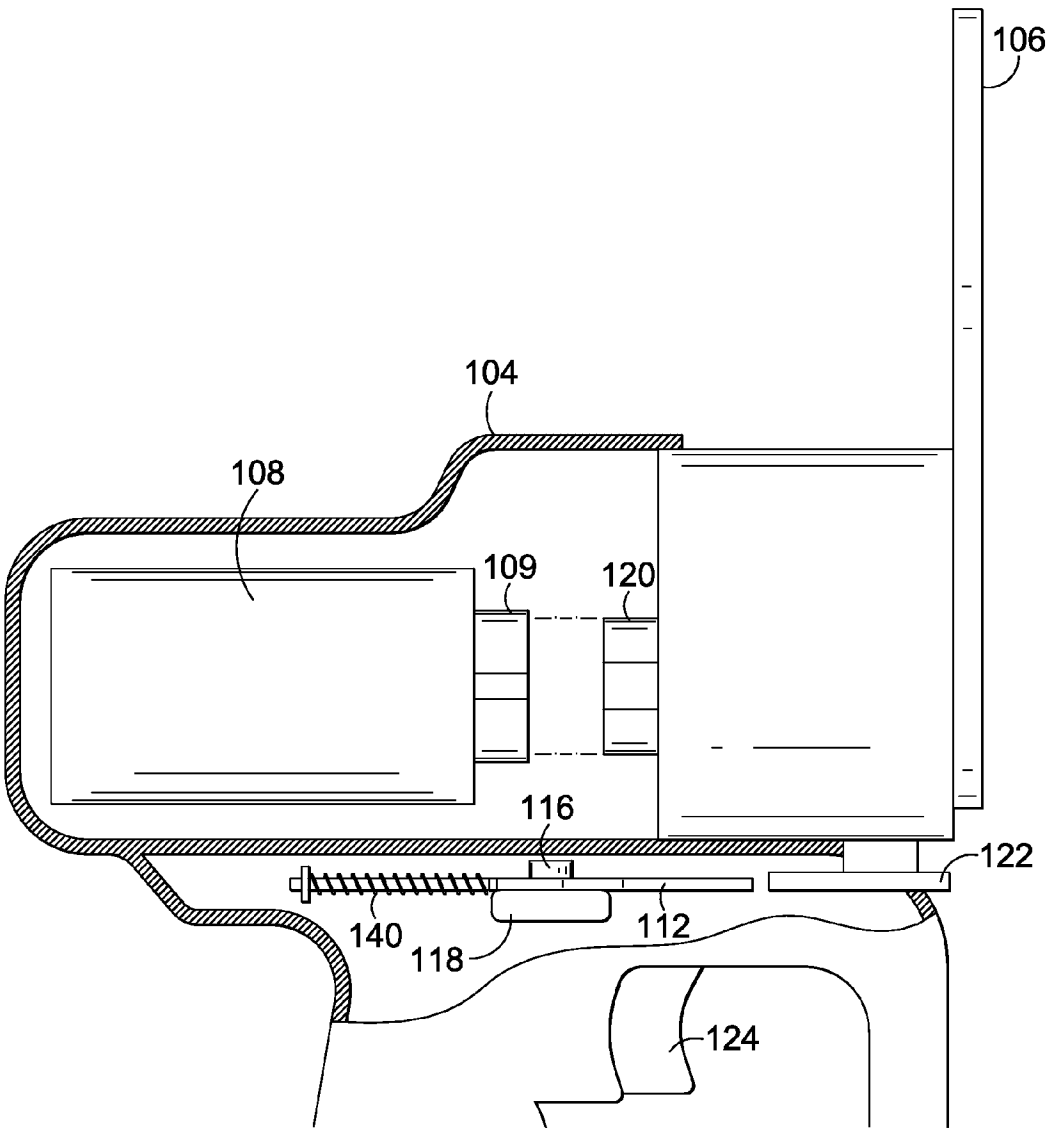
FIG. 4 is a fragmentary, cross section view of a portion of the handheld power tool assembly and tool head of FIG. 1 in which the tool head is shown in the process of being attached to the tool housing and rotary assembly in accordance with an embodiment of the present invention.
Figure 6:
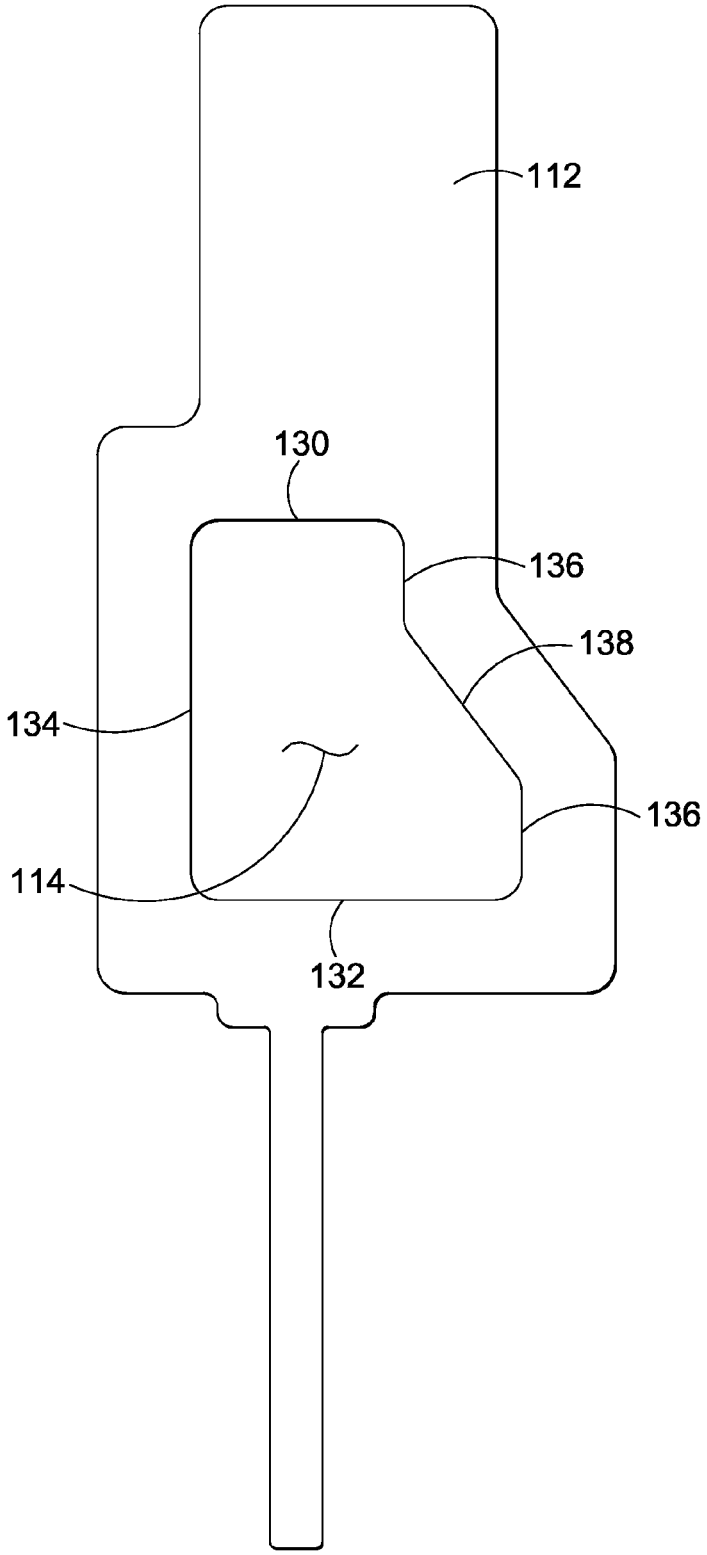
FIG. 6 is a top plan view of a plate member of a handheld power tool assembly in accordance with an embodiment of the present invention.

Referring to FIG. 2, the handheld power tool 100 also comprises a plate member 112. Further details of the plate member are shown in FIG. 6 and discussed below. The plate member 112 includes an opening 114 which is sized to limit the movement of a retainer pin 116, which is positioned within the opening 114, and is associated with a direction-selection switch 118. By selectively limiting movement of the direction-selection switch 118, the plate member 112 is able to control the rotational direction of the shaft 110. Depending upon the preferred construction, the retainer pin 116 is coupled to the direction-selection switch 118 or formed integral with the direction-selection switch 118.

As previously discussed, the handheld power tool 100 also includes a detachable tool head 106. However, it is desirable to be able to change the tool head 106 to a different type of tool head depending on the operation to be performed. The detachable tool head 106 is coupled to the rotary assembly 108 and the tool housing 104. This attachment and detachment process is shown in more detail in FIGS. 3-5. The detachable tool head 106 includes a mounting portion 120 which couples with the alignment flange of the rotary assembly 108, as shown in FIGS. 1 and 3-5.

Figure 7B:
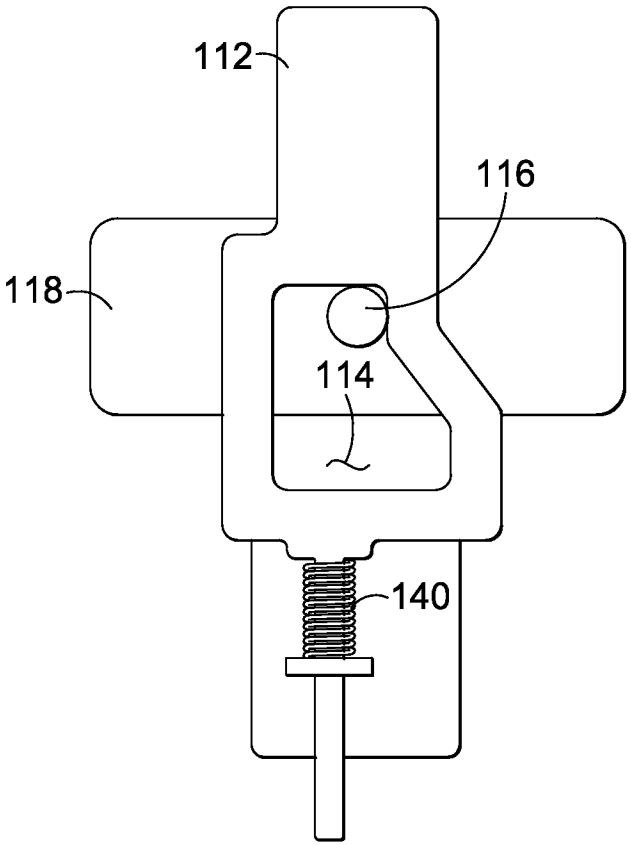
FIG. 7B is a top plan view of a direction-controlling assembly for use in a handheld power tool assembly in an orientation where rotational movement is restricted in accordance with an embodiment of the present invention; and, FIGS. 8A, 8B, and 8C depict top plan views of a direction-controlling assembly for use in a handheld power tool assembly depicting different positions for the plate member in accordance with an embodiment of the present invention.
Figure 7A:
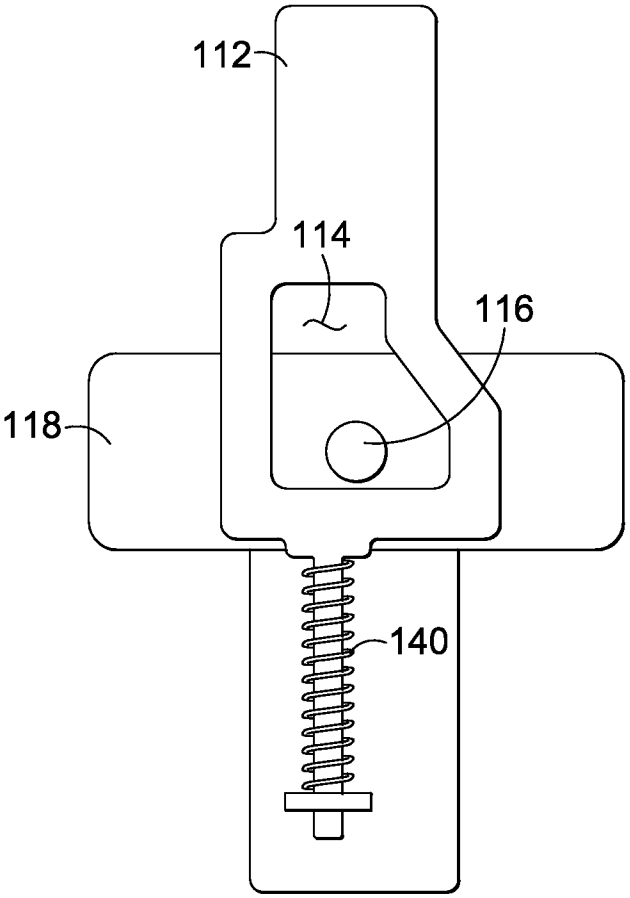
FIG. 7A is a top plan view of a direction-controlling assembly for use in a handheld power tool assembly in an orientation where rotational movement is not restricted in accordance with an embodiment of the present invention.
Figure 8A:
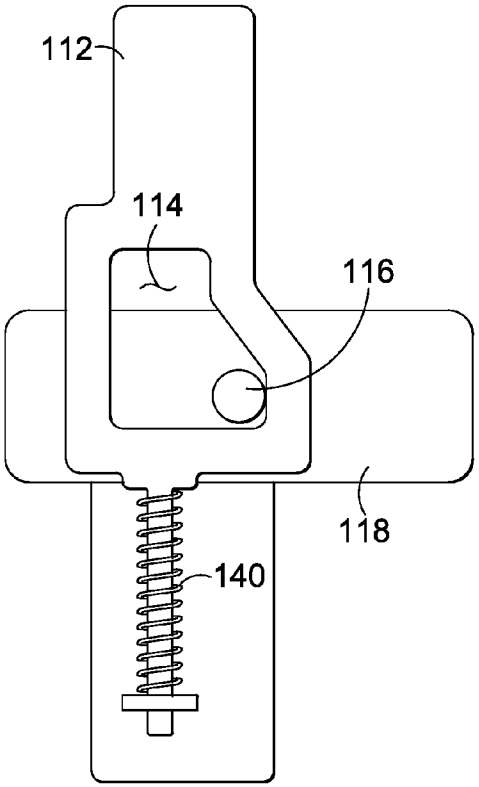
Figure 8B:
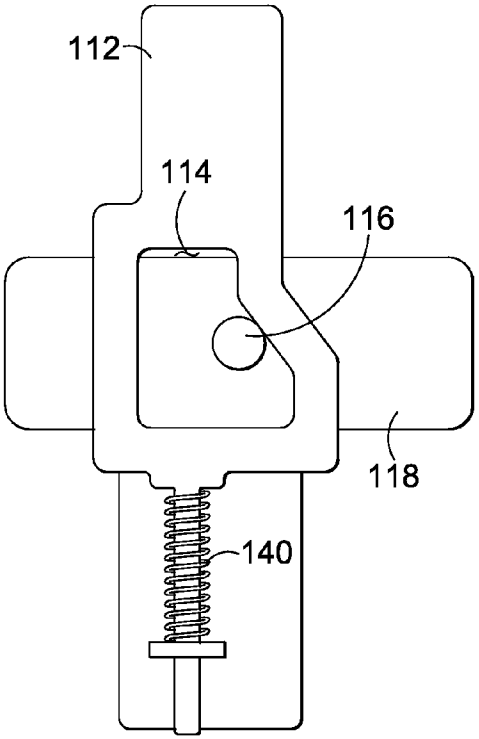
Figure 8C:
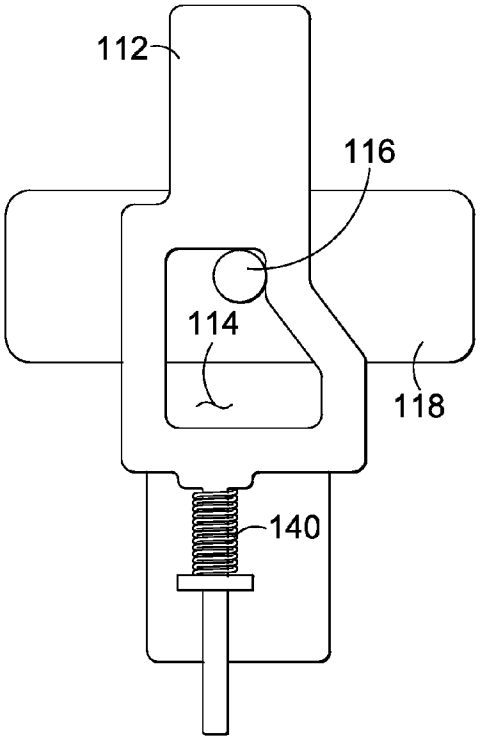
Figure 9A:
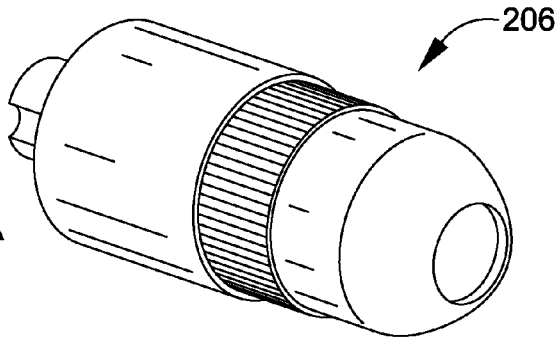
FIG. 9A is a perspective view of a drill head according to an exemplary embodiment of the present invention.
Figure 9B:
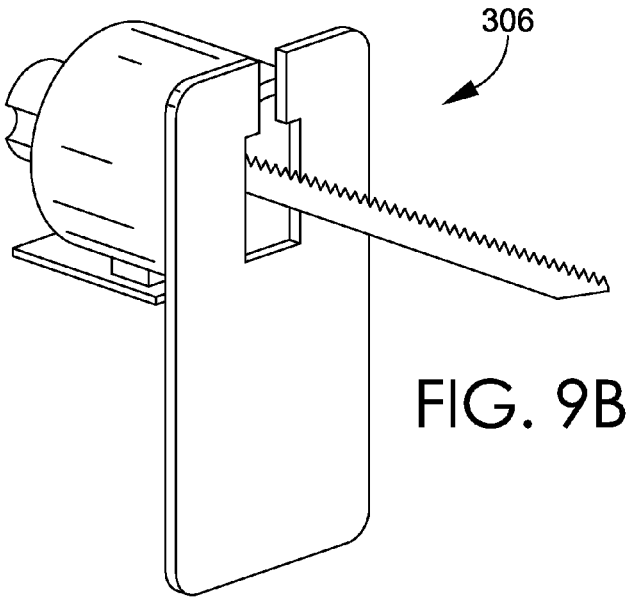
FIG. 9B is a perspective view of a jigsaw head according to an exemplary embodiment of the present invention.
Figure 9C:
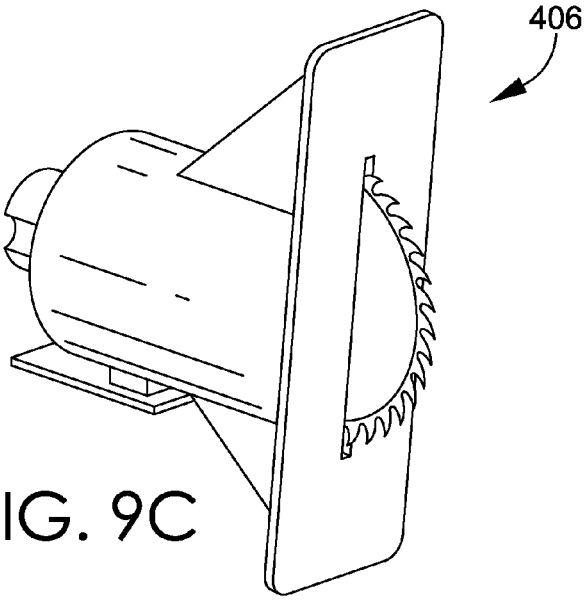
FIG. 9C is a perspective view of a circular-saw head according to an exemplary embodiment of the present invention.

In an embodiment of the present invention, the detachable tool head 106 also includes a projection with a contact plate 122 that is capable of contacting the plate member 112. Depending on the detachable tool head 106 that is selected and coupled with the tool housing 104, the contact plate 122 may contact the plate member 112 such that the plate member 112 translates axially. The translating or sliding movement of the plate member 112 causes the opening 114 to also translate axially and thereby restrict movement of the retainer pin 116. FIGS. 7A and 7B depict the axial translation of the plate member 112 relative to the retainer pin 116. Because the retainer pin 116 is coupled to the direction-selection switch 118, by restricting movement of the retainer pin 116, selection of the direction of rotation is thereby limited.

The size (i.e. length) of the contact plate 122 will determine whether the plate member 112 will move, thereby restricting movement of the retainer pin 116 and selection of a rotational direction of movement for the tool head 106. Therefore, preventing rotational capability of the tool head is controlled by the size of the contact plate 122. That is, for tool heads such as drills (206), where rotational movement in both forward and reverse is desired, the contact plate 122 is sized to not contact the plate member 112 or the contact plate 122 can be omitted altogether.

Figure 5:
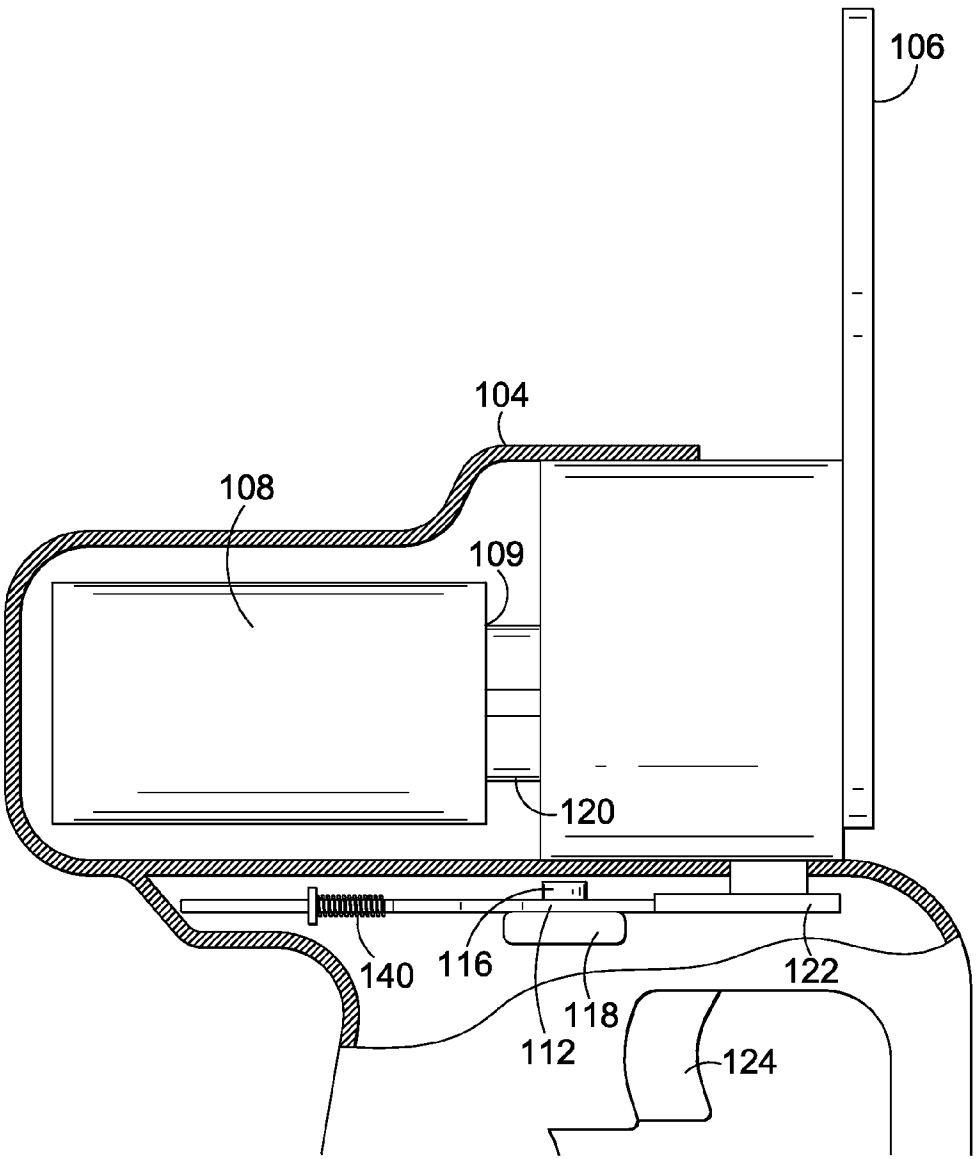
FIG. 5 is a fragmentary, cross section view of a portion of the handheld power tool assembly and tool head of FIG. 1 in which the tool head is shown attached to the tool housing and rotary assembly in accordance with an embodiment of the present invention.

On the other hand, when a tool head 106 such as a sander, jigsaw (306), or circular saw (406) is coupled with the tool housing 104, it is preferred that these tools not operate in a reverse direction. Rotational movement of the shaft in one direction only is desired for use with saw head components because the rotation of the axis in a forward direction causes the saw blade to move in a direction favorable to cutting. Movement in an opposite direction inhibits cutting, and an operator may be inclined to apply more force to try and force the saw to cut, potentially breaking the saw blades or causing other potential injuries. Therefore, in order to prevent rotation in a reverse direction, the contact plate 122 is sized such that when the detachable tool head 106 is coupled with the tool housing 104 and rotary assembly 108 (as shown in FIG. 5), the contact plate 122 contacts the plate member 112, causing the plate member 112 to translate axially or slide from a position depicted in FIG. 7A to a position depicted in FIG. 7B. In this configuration, the plate member 112 moves due to contact with the contact plate 122 and the retainer pin 116 is only able to toggle between a forward direction position and a neutral, non-rotational position. Furthermore, when the detachable tool head 106 is not attached to the rotary assembly 108, the retainer pin 116 is in a neutral position, but is permitted to select either a forward and/or reverse direction. An example of this configuration is shown in FIG. 2.

The handheld power tool 100 also comprises a trigger switch 124 located in the handle 102. Through the trigger switch 124, an operator is able to activate and control the motor of the rotary assembly 108 by regulating the power supplied to the motor from a power source (not shown).

In an embodiment of the present invention, a plate member 112 for controlling a direction of a rotating member of a power tool is disclosed. The plate member 112 is depicted in FIG. 6 and comprises a planar member having a thickness and an opening 114 having a first edge 130 and a second edge 132 opposite and generally parallel to the first edge 130. The opening 114 also comprises a third edge 134 that is generally perpendicular to the first edge 130 and a plurality of fourth edges 136 generally parallel to the third edge 134. The opening 114 also comprises a fifth edge 138 that extends between the fourth edges 136 and is oriented at an angle relative to the fourth edges 136. The orientation of the fifth edge at an angle provides a camming surface or way for the plate member 112 to move given the retainer pin 116. The plate member 112 may be formed out of sheet metal.

As shown in FIG. 6, the first edge 130 has a first length that is shorter than a second length of the second edge 132. Referring to FIGS. 7A and 7B, depending on the position of the plate member 112, the retainer pin 116 can move between two positions along the first edge 130 and between three positions along the second edge 132. When the retainer pin 116 is adjacent the first edge 130 (as in FIG. 7B), the power tool 100 is capable of operating in forward and neutral positions. Furthermore, when the retainer pin 116 is adjacent the second edge 132 (as in FIG. 7A), the power tool 100 is capable of operating in a forward, neutral, and reverse conditions.

Located adjacent an end of the plate member 112 is a spring 140 for biasing the plate member 112 in its nominal position, as shown in FIG. 7A. Referring to FIGS. 3, 5, 7A, and 7B, the spring 140 is used to bias the plate member 112 in a position permitting three-way movement of the direction-selection switch 118. However, when the plate member 112 has moved axially rearward with respect to the tool head and downward in the drawings due to a force applied by the contact plate 122, the spring 140 is compressed, and the position of plate member 112 prevents selection of a reverse direction by the direction-selection switch 118, as shown in FIG. 7B, where the retainer pin 116 is located adjacent to the first edge 130 of opening 114. However, when a non-reverse tool head 106 is removed, the plate member 112 is returned to its previous position, shown in FIG. 7A, due to the bias of spring 140.

In an embodiment of the present invention, a direction-controlling assembly 130 is disclosed. The direction-controlling assembly 130, which is depicted in FIGS. 7A and 7B, comprises the plate member 112 and an opening 114 extending therethrough and located within the plate member 112. The opening 114 is in accordance with the opening previously described above. The direction-controlling assembly 130 also comprises a direction-selection switch 118 having a retainer pin 116 extending therefrom, with the retainer pin 116 positioned within the opening 114 of the plate member 112. Movement of the direction-selection switch 118 may be restricted depending on the type of detachable tool head attached to the power tool 100 and the location of the opening 114 of the plate member 112 relative to the retainer pin 116.

The present invention has been described in relation to particular embodiments, which are intended in all respects to be illustrative rather than restrictive. Alternative embodiments will become apparent to those of ordinary skill in the art to which the present invention pertains without departing from its scope. Substitutions may be made and equivalents employed herein without departing from the scope of the invention as recited in the claims. It will be understood that certain features and subcombinations are of utility and may be employed without reference to other features and subcombinations. This is contemplated and within the scope of the claims.

The invention claimed is:

1. A handheld power tool comprising:
- a handle;
- a tool housing;
- a rotary assembly located within the tool housing and capable of rotating a shaft in a forward and reverse direction;
- a plate member having an opening located therein;
- a detachable tool head couplable to the rotary assembly and the tool housing, the tool head having a contact plate capable of contacting the plate member; and
- a retainer pin positioned within the opening of the plate member, the retainer pin coupled to a direction-selection switch;
- wherein upon axial movement of the plate member by the contacting plate the opening in the plate member limits movement of the retainer pin and selection of an operating direction by the direction-selection switch.

2. The handheld power tool of claim 1, wherein movement of the plate member depends on the type of tool head coupled to the tool housing and rotary assembly.

3. The handheld power tool of claim 1, wherein the handle further comprises a trigger switch for activating the rotary assembly.

4. The handheld power tool of claim 1, wherein when a sanding head, a jigsaw head or a circular saw head are coupled to the power tool, the plate member slides in an axial direction such that the retainer pin is located adjacent to a first end of the plate member.

5. The handheld power tool of claim 4, wherein the shaft is prevented from a reverse motion when the sanding head, jigsaw head or circular saw head is coupled to the power tool.

6. The handheld power tool of claim 1, wherein the pin is moved to a neutral position from a reverse position when a tool head having a contact plate is coupled with the rotary assembly.

7. The handheld power tool of claim 1, wherein the rotary assembly is permitted to operate in a reverse motion when a drill head is attached.

8. The handheld power tool of claim 1, wherein the plate member permits forward and reverse motion of the rotary assembly when no tool head is attached to the rotary assembly.

9. A handheld power tool comprising:
- a tool housing;
- a rotary assembly located within the tool housing and capable of rotating a shaft in a forward and reverse direction;
- a plate member located within the tool housing and having an opening therein;
- a detachable tool head coupled to at least the rotor assembly, the detachable tool head having a contact plate capable of contacting the plate member; and,
- a retaining pin positioned within the opening of the plate member, the retaining pin coupled to a direction-selection switch;
- wherein the plate member is biased in a nominal position thereby allowing for lateral movement of the retaining pin for selection of the forward or reverse direction for the shaft.

10. The handheld power tool of claim 9, wherein the contact plate of the detachable tool head does not contact the plate member.

11. The handheld power tool of claim 9, further comprising a spring located adjacent an end of the plate member, wherein the spring biases the plate member in the nominal position, wherein the detachable tool head has a contact plate in contact with the plate member, thereby compressing the spring and adjusting location of the plate member from the nominal position, to restrict the lateral movement of the retaining pin.

12. The handheld power tool of claim 11, wherein the rotor assembly is limited to movement in a forward direction.

13. A handheld power tool comprising:
- a handle;
- a tool housing;
- a rotary assembly located within the tool housing and capable of rotating a shaft in a forward and reverse direction;
- a plate member for controlling rotation direction of the rotor assembly comprising:
  - a planar member having a thickness; and
  - an opening extending through the thickness and located within the planar member, the opening having:
    - a first edge having a first length;
    - a second edge opposite to the first edge and having a second length longer than the first length;
    - a third edge extending between and connecting the first edge and the second edge;
    - a plurality of fourth edges opposite to the third edge, one of the fourth edges connected to the first edge and another of the fourth edges connected to the second edge;
    - a fifth edge extending between the fourth edges and oriented at an angle relative to the fourth edges;

a detachable tool head coupleable to the rotary assembly and tool housing, the tool head having a contact plate capable of contacting the plate member; and a retainer pin positioned within the opening of the plate member, the retainer pin coupled to a direction-selection switch;

wherein the plate member is capable of translating axially in order to limit directional rotation of the rotary assembly.

14. The handheld power tool of claim 13, wherein the plate member is capable of sliding between multiple positions and wherein the retainer pin is capable of moving between two positions along the first edge and between three positions along the second edge.

15. The handheld power tool of claim 14 further comprising a spring adjacent an end of the plate member.

16. The handheld power tool of claim 15, wherein the contact plate causes the plate member to compress the spring at an end of the plate member opposite the contact plate.

17. The handheld power tool of claim 16, wherein when the plate member compresses the spring, the retainer pin is located adjacent the first edge of the plate member.

18. The handheld power tool of claim 17, wherein the rotating shaft is limited to movement in the forward direction.

19. The handheld power tool of claim 15, wherein when the spring is in an uncompressed state, the retainer pin is located adjacent the second edge of the plate member.

20. The handheld power tool of claim 19, wherein the retainer pin is movable within the opening, when located adjacent the second edge, to operate the direction-selection switch and to dictate movement of the rotating shaft in the forward or reverse directions.

* * * * *